US006550067B2

(12) United States Patent
Force

(10) Patent No.: US 6,550,067 B2
(45) Date of Patent: Apr. 22, 2003

(54) NURSING BRASSIERE GARMENT

(76) Inventor: Jillaine Bee Force, 527 N. Francisca Ave., Redondo Beach, CA (US) 90277

( * ) Notice: Subject to any disclaimer, the term of this patent is extended or adjusted under 35 U.S.C. 154(b) by 0 days.

(21) Appl. No.: 09/844,305

(22) Filed: Apr. 27, 2001

(65) Prior Publication Data

US 2001/0039672 A1 Nov. 15, 2001

Related U.S. Application Data

(60) Provisional application No. 60/204,243, filed on May 15, 2000.

(51) Int. Cl.[7] ..... A41D 1/20

(52) U.S. Cl. ..... 2/104; 2/105; 2/106; 2/69; 450/36; 450/37; 450/1

(58) Field of Search ..... 2/69, 104, 106, 2/105, 78.1, 114; 450/36, 37

(56) References Cited

U.S. PATENT DOCUMENTS 907,290 A * 12/1908 Rouff ..... 2/104
1,109,815 A * 5/1914 Knapp ..... 2/104
2,661,472 A * 12/1953 Miller ..... 2/105
2,928,396 A * 3/1960 O'Dell ..... 2/104
3,176,692 A * 4/1965 Marino ..... 2/78.1
4,144,593 A * 3/1979 Timmons ..... 2/104
4,208,743 A * 6/1980 Whitcraft ..... 2/104
4,446,572 A * 5/1984 Lindquist ..... 2/104
4,566,136 A * 1/1986 Echols ..... 2/104
4,648,404 A * 3/1987 Clark ..... 2/104 X
4,660,227 A * 4/1987 Abramson ..... 2/104
4,759,083 A * 7/1988 Belcher ..... 2/114
5,440,763 A * 8/1995 Shah et al. ..... 2/114

* cited by examiner

*Primary Examiner*—Gloria M. Hale

(57) ABSTRACT

This invention relates to a brassiere garment for use in nursing. The brassiere garment is constructed as a garment. The brassiere garment portion of the garment has adequate support and is provided with cups which can be opened and closed without having to unfasten a brassiere garment from a wearer. The cups fit snugly enough to hold breast pads in place. The garment portion is aesthetically pleasing. Thus the invention provides a garment which is self sufficient, not requiring a bra.

10 Claims, 4 Drawing Sheets

FIG 2A
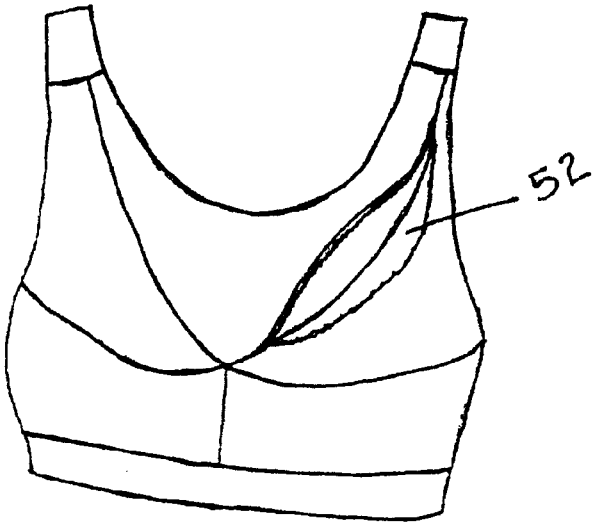
FRONT
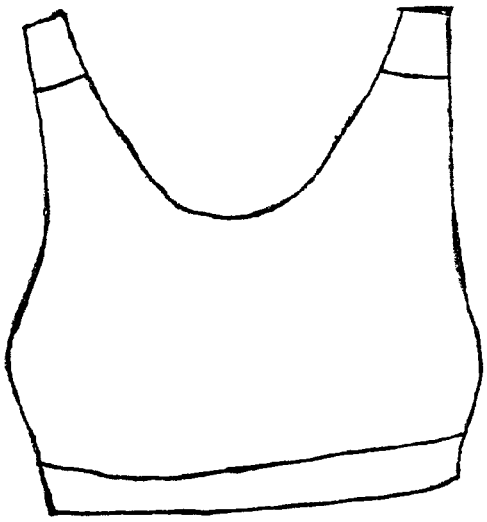
BACK
FIG 2B

NURSING BRASSIERE GARMENT

This application claims the benefit of U.S. Provisional Application No. 60/204,243 filed on May 15, 2000.

REFERENCES

U.S. Pat. No. 5,024,628 Sanchez; Mary M. Jun. 18, 1991

U.S. Pat. No. 5,611,086 Eggen; Kathleen R. Mar. 18, 1997

U.S. Pat. No. 5,461,725 Witczak; Pamela A. Dec. 30, 1991

U.S. Pat. No. 4,633,876 Scullin; Mary E. Jan. 6, 1987

U.S. Pat. No. 5,008,960 Hemming; Valda K. Apr. 23, 1991

BACKGROUND

Women have had trouble finding clothing that is functional for wear when nursing babies. What many women's desires is something comfortable and tasteful, yet convenient when nursing. Women want clothing which allows for easy access to breast at appropriate times. Therefore, the nursing session can be fulfilled without a hassle. Some women must move the top garment to access her brassiere. The garment designs normally require the wearer to use two hands to move the garment open, usually by way of a button or snap. This is an inconvenience to the wearer since some women have one hand on a baby and the other to access breast. Unfortunately it takes two hands to unbutton or unsnap the garment. Also, most nursing brassieres require the need for dexterous manipulation. The average nursing brassiere is usually constructed with some type of fastener in order to open and close a brassiere cup. The awkwardness of the prior designs and the need for dextrous manipulation of the clothing and brassiere for a breast exposer are particularly an undesirable feature. Previous attempts to provide suitable clothing have typically been characterized by either: 1. a slit or flap type offering no support. Therefore, the women had to wear a brassiere also. 2. a bodice type with stretchable fabric straps, therefore when pulled downward the entire breast is exposed not allowing for discreteness. This design also offers very little support. What is needed is a single self-sufficient garment suitable for nursing. A garment with adequate support, that is attractive with easy access to breast while still being discrete.

OBJECTS OF THE INVENTION

It is therefore a primary object of the invention to provide for a nursing brassiere garment that can be worn without the need of a conventional brassiere for easy access to breast.

It is yet another object of the invention to provide a nursing brassiere garment that offers support and is aesthetically pleasing .

It is yet a further object of the invention to provide for a nursing brassiere garment that does not require the need for dexterous manipulation while the breast cups are being opened and closed.

It is yet another object of the invention to provide for a nursing brassiere garment which can comfortably expand and contract as is common in lactating breast. The ability to expand and contract is derived from the stretchable fabric which is utilized and also facilitates the opening and closing of the breast cup.

It is yet another object of the invention to provide for a nursing brassiere garment that can be worn other than in nursing. When the top front panel and front yoke panel are combined into a single piece to form an outside panel.

SUMMARY

The problems mentioned are in large measure solved by an innovative garment invention. That is to say, the invention hereof provides an attractive garment which is self sufficiently. It is supportive and does not need the additional security of a brassiere. The opening and closing of a breast cup to access breast milk for baby are done by separating top front panel from front yoke panel and do not require any fastening means. The brassiere garment optionally provides sleeves for additional aesthetics. The present invention also provides a skirt for a tasteful effect. The straps are reinforced with a tightly woven stretchable mesh fabric which is sandwiched between the topside fabric and underside fabric. This allows for better support. An elastic band which is attached along a lower edge of front bottom panel and lower edge of back panel allowing for additional support. It should also be noted that the top front panel and the front yoke panel may be combined or attached to form a single panel therefore garments can be worn other than in nursing.

OPERATION OF THE PREFERRED EMBODIMENT

The nursing brassiere garment operates as follows; the object of the design is so as not to have to bother with an undergarment, that being a nursing brassiere, or an overgarment, that being a nursing garment. When the nursing brassiere has garment attached it becomes less troublesome to access breast milk for babies consumption.

When a nursing session is to take place, the mother simply pulls down on top front panel 40 while front yoke panel 32 remains, therefor the breast is suitably exposed for nursing baby.

The midriff panel 20 is desirable if the woman prefers to hide her midriff. The midriff panel 20 does not interfere in any way with the pull down function of the top front panel 40.

The straps 30 deform and elongate slightly to accommodate this motion.

The sleeves 14 and 18 do not interfere with the operation of accessing breast milk.

When the nursing session is complete, the top front panel 40 is simply grasped and pulled over breast and the nursing brassiere garment resumes its original shape.

Therefore the brassiere garment provides a garment which is attractive yet convenient and self sufficient.

BRIEF DESCRIPTION OF THE DRAWINGS

FIG. 2A is a front view of the brassiere by itself without garment attached with left side of bra cup open.

FIG. 2B shows back view of brassiere.

DETAILED DESCRIPTION OF THE PREFERRED EMBODIMENT

The present invention is a nursing brassiere garment for nursing a baby. The nursing brassiere garment provides easy access to breast milk for baby's consumption. The main inventive feature is that the nursing brassiere garment has the support of a conventional brassiere and is constructed as a conventional garment to be worn in a public place. It has sleeves, midriff panel and/or skirt attached as to look like a conventional garment. The fabric utilized is fashionably decorative and resilient.

Figure 1:
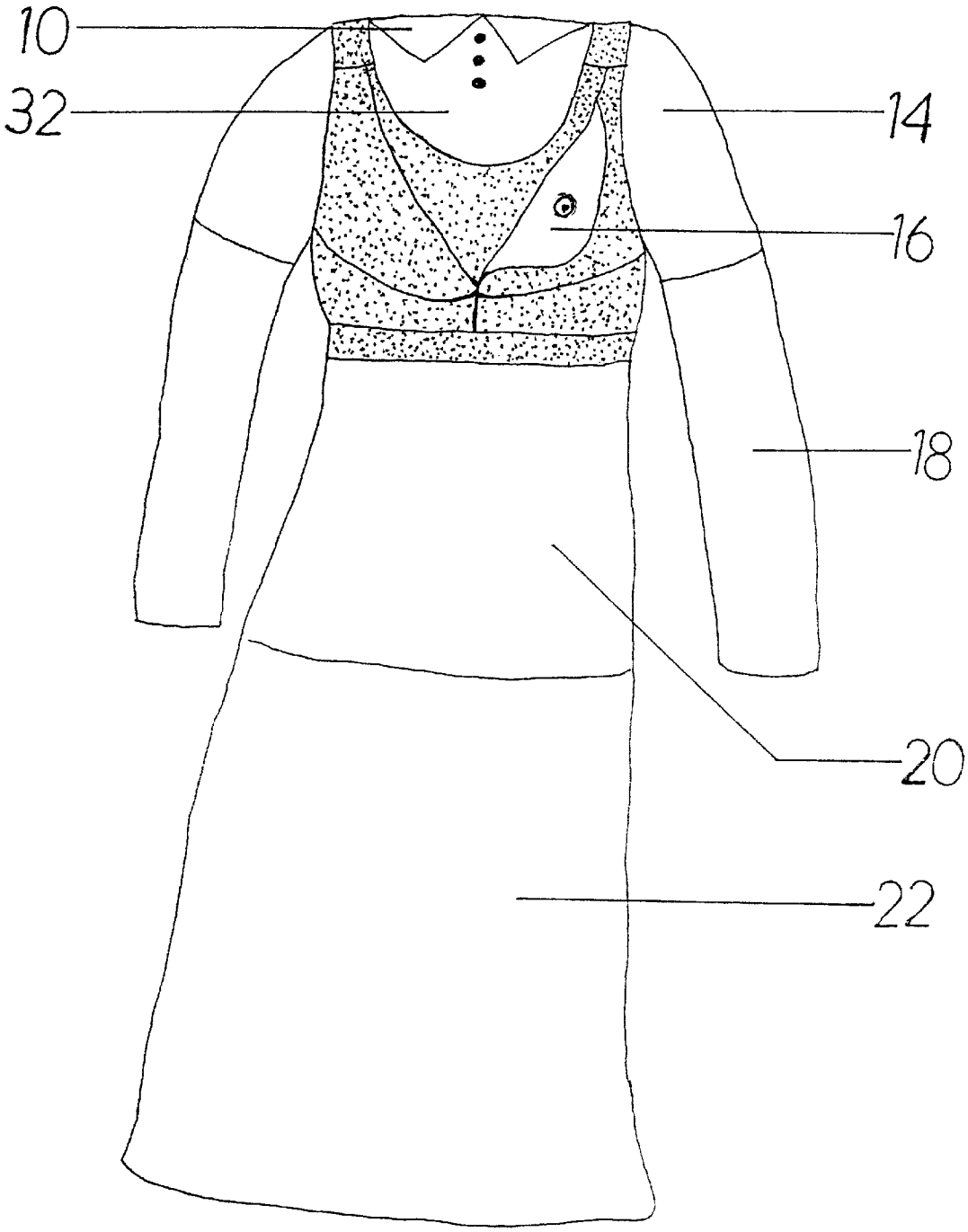
FIG. 1 is a front view of the brassiere garment showing each garment piece attached with brassiere portion shaded and bra cup open.
Figure 4:
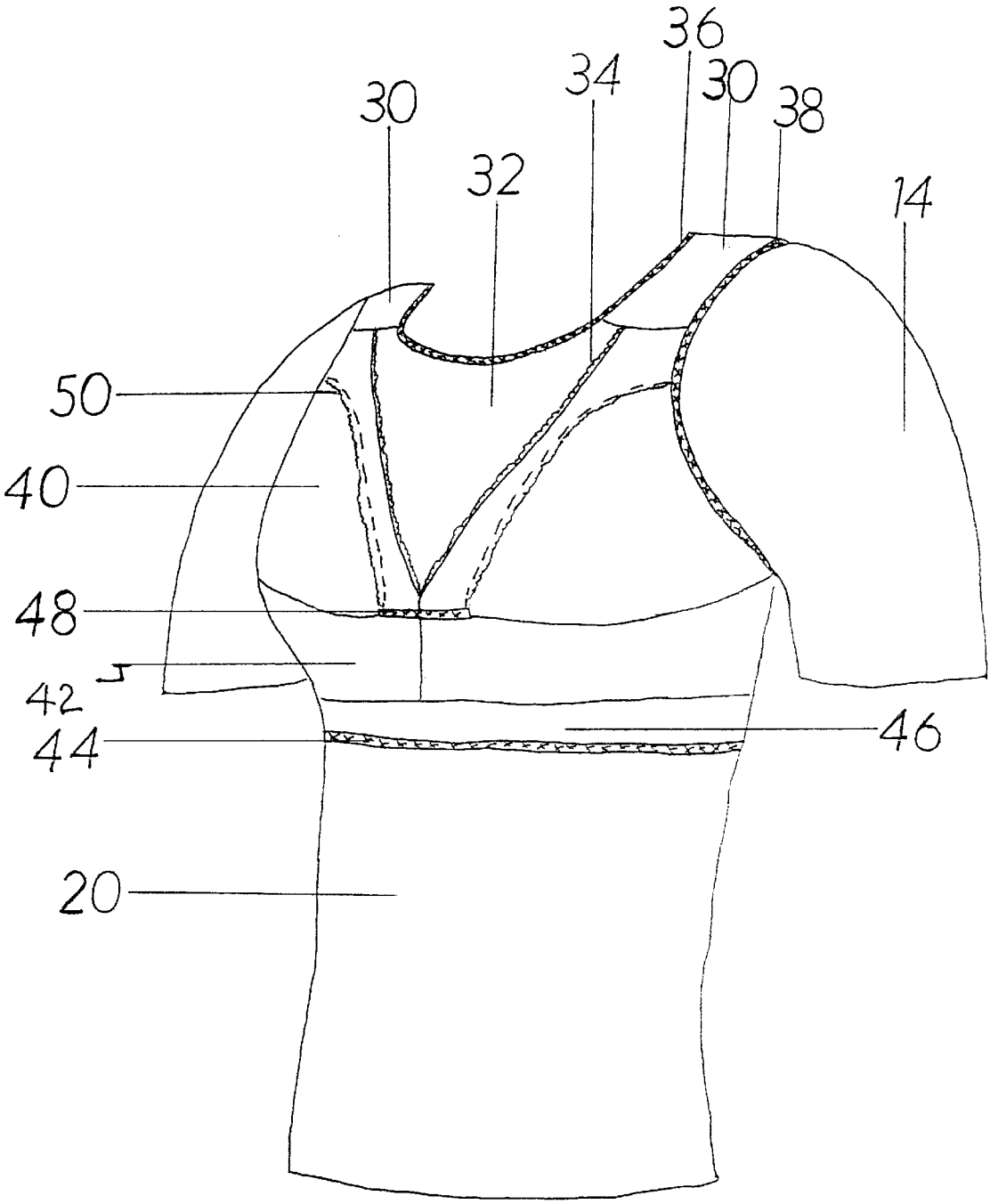
FIG. 4 is a perspective of the brassiere garment.

FIG. 1 shows a map of the nursing brassiere garment, including the brassiere portion 16 in the shaded area. The brassiere portion 16 is shown in greater detail in FIG. 4. Referring now to FIG. 4 The brassiere portion comprise of a pair of breast cups that fit snugly and are connected together at a cleavage seam, each include a top front panel 40, attached horizontally on its lower edge to the upper edge of the bottom front panel 42. The top front panel 40 folds over an inside front panel 32 and is shown with underside depicted by dotted lines. The inside front panel 32 is attached at seam 48, the middle of seam 38 and at the lower edge of the shoulder strap 30. The size of these panel pieces depends solely on the size of the nursing brassiere garment. The lower edge 50 of inside front panel 32 is unattached to upper diagonal edge 34 of top front panel 40 creating an obscure slit type opening, therefor the nursing brassiere garment appears to be an ordinary conventional article of clothing to be worn in a public place but has the convenience to nurse a baby by pulling downward on the top front panel 40 and the inside front panel 32 remains creating an opening to expose breast. The slit is preferable as a more discrete type of opening. Front inside panel 32 and top front panel 40 are combined to form a conventional breast cup, therefor the garment can be worn as a non-nursing article of clothing. Bottom front panel 42 and top front panel 40 are lined preferably with fabric that keeps moisture away from the body.

Shoulder straps 30 are attached to the upper horizontal edge of the bra cups in the front and in the back to the top back panel. The shoulder straps 30 contain a tightly woven stretchable mesh fabric sandwiched between the top side fabric 30 and lining side fabric (52 as seen FIG. 2A). This fabric is used for supplementary support needed for a full lactating breast.

An elastic band 46 shown illustrated in FIG. 4 circles around horizontally and fits snugly underneath the breast thus providing additional support. The midriff panel 20 covers the wearers torso and is attached horizontally to the lower edge of elastic band 46 along seam 44, and on the side line seams to a bottom back panel, therefor the modest wearer has the confidence to wear the garment in a public place.

A short sleeve panel 14 or a long sleeve panel 18, or any length in between, when utilized are in the shape of sleeves. Therefor the garment has sleeves to cover the wearers arms and are attached on the armhole 38 seam. The garment may but need not have sleeves.

Figure 3:
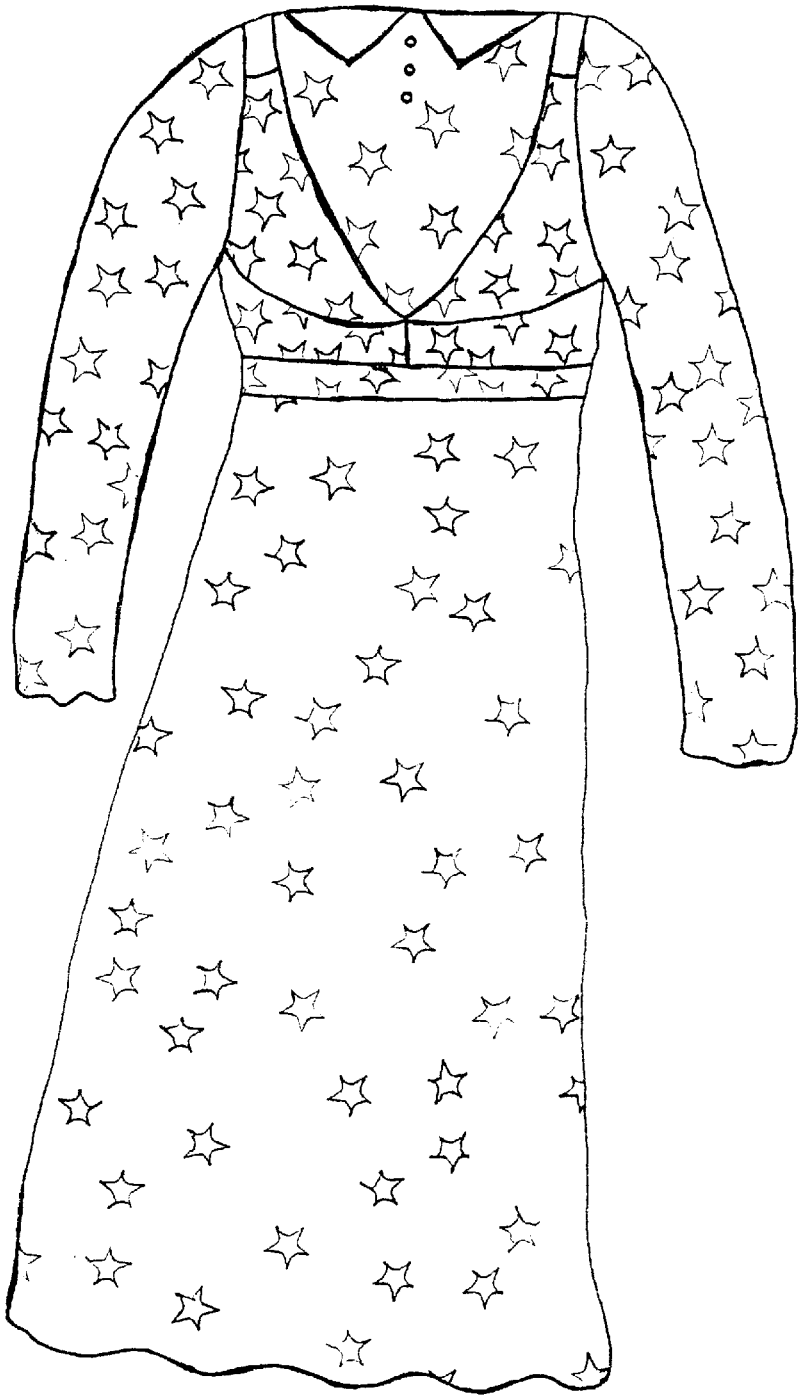
FIG. 3 shows the brassiere garment as a dress with a decorative fabric.

In FIG. 4 the skirt panel 22 includes a front skirt panel and a back skirt panel attached together at the vertical side line seams. And extends downward covering the legs of the wearer and is in the shape of a skirt, the garment takes on the form of a dress, shown in FIG. 3. The nursing brassiere garment has the aesthetic appeal of a conventional garment, the fabric has the appropriate appearance of a garment to be worn in public, and has at least 5% of an elasticized content so as to expand and contract to the ever changing lactating breast. The lining fabric may have an absorbent and anti-bacterial property content for accidental leakage of the breast milk.

Shown in FIG. 1 the garment is shown with a collar band 10 to further give the garment the look of a conventional article of clothing. The seam attachment is shown in FIG. 4 and is located at seam 36 around the neckline.

FIG. 2A is the front of the brassiere portion shown in the open position. The back of the brassiere portion is shown in FIG. 2B. This portion of the garment fits snugly to the body offering the support of a conventional brassiere.

Although the style of the nursing brassiere garment shown in the drawings is not limited to the description herein, with reference to its preferred embodiment and certain described alternatives, this description is by way of example only and is not to be construed in a limiting sense. However it should be understood that variations and modifications can be effected within the scope and spirit of the invention as described before and as defined in the appended claims.

What is claimed is:

1. A nursing brassiere garment for use when nursing a baby that supports a pair of breasts, constructed of fabric that is appropriate to be worn in a public place comprising:

a pair of close fitting breast cup panels to hold up and secure a pair of breasts;

a front yoke panel above said breast cup panels and attached to a shoulder strap on an upper edge and along a horizontal center seam on a lower edge;

a top back panel extending across a wearer's upper back and joined together on vertical side line seams of attachment under the wearer's arms to said breast cup panels:

a set of shoulder straps attached in the front of said garment above said breast cup panels to hold said breast cup panels up and which go over a wearers' shoulders offering lift and support for said wearer's breast and another end of each of said shoulder straps attached at an upper edge of said top back panel in the back of said garment;

an elastic band for snugly circling around said wearer's torso horizontally providing extra support for said wearer's breast to help eliminate or minimize sagging; said elastic and is attached directly below said breast cup panels in the front and to a lower edge of said top back panel in the back;

a midriff panel for covering a woman's midriff thereby protecting a woman's modesty while wearing the nursing brassiere garment in public and which extends downwardly covering a wearer's torso and wherein said midriff panel is attached around a lower horizontal edge of said elastic band;

a bottom back panel for covering the wearer's lower back and which is joined to said midriff panel on vertical side line seams with attachment under the wearer's arms:

wherein said nursing brassiere garment is constructed of an appropriate fabric for conventional exterior garment wear to be worn in a public place ad which has at least 5% elasticized material content therein and wherein it is stretchable in at least one direction so as to enable a pair of breasts to expand and contract as is common in lactating breasts; and wherein said breast cup panels include an access opening therein or between said yoke panels and said breast cup panels.

2. A nursing brassiere garment as claimed in claim 1 wherein said breast cups further comprise a right breast cup and a left breast cup; said breast cups are attached together vertically at a center cleavage seam; each of said breast cups having a top front panel and a bottom front panel and are attached together horizontally on the upper edge of said bottom front panel and lower edge of said top front panel;

said top front panel folds over said front yoke panel, wherein the diagonal upper edge of said top front panel and the diagonal lower edge of said front yoke panel are unattached so as to be stretched or elongated by pulling downward on said top front panel thereby separating the breast cup and exposing the breasts.

3. A nursing brassiere garment as claimed in claim 2 further comprising a right sleeve panel and a left sleeve panel covering a wearer's arms; said sleeve panels disposed on right and left sides of the garment and are attached at arm hole seams of the garment below a wearer's shoulders.

4. A nursing brassiere garment as claimed in claim 3 wherein said sleeve panels are in the general form of sleeves.

5. A nursing brassiere garment as claimed in claim 4 further comprising a skirt portion; said skirt portion extends downward covering a wearer's lower half of the body and is attached below said elastic band.

6. A nursing brassiere garment as claimed in claim 5 wherein said skirt portion is in the form of a dress.

7. A nursing brassiere garment as claimed in claim 6 further comprising a neck portion and an attached collar.

8. A nursing brassiere garment as claimed in claim 1 wherein said shoulder straps contain a tightly woven mesh fabric that is sandwiched between a top side fabric of said shoulder straps and a lining side fabric of said shoulder straps thereby giving the shoulder straps additional strength, whereby a wearer's breast would be lifted and supported.

9. A nursing brassiere garment as claimed in claim 1 wherein said breast cups have a lining layer including anti-bacterial and/or absorbent properties within the fabric to accommodate accidental leakage of the breast milk.

10. A nursing brassiere garment as claimed in claim 2 wherein said top front and front yoke panels are structured such that said panels can be permanently sealed by a seam after nursing use and a child is weaned thus creating one panel and wherein the garment can be worn as a standard article of clothing.

* * * * *